US006081236A

United States Patent [19]

Aoki

[11] Patent Number: 6,081,236

[45] **Date of Patent: *Jun. 27, 2000**

[54] ANTENNA APPARATUS WITH A COAXIAL CABLE USED AS A RADIATION ELEMENT

[75] Inventor: Kouta Aoki, Yokohama, Japan

[73] Assignee: Matsushita Electric Industrial Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,338

[22] Filed: Mar. 31, 1997

[30] Foreign Application Priority Data

Apr. 26, 1996 [JP] Japan ..... 8-107758

[51] Int. Cl.[7] ..... H01Q 1/24

[52] U.S. Cl. ..... 343/702; 343/792; 343/895

[58] Field of Search ..... 343/702, 791, 343/830, 895, 792; H01Q 1/24

[56] References Cited

U.S. PATENT DOCUMENTS

| | | | |
|---|---|---|---|
| 3,576,578 | 4/1971 | Harper | 343/792 |
| 3,582,952 | 6/1971 | Heins | 343/830 |
| 4,138,681 | 2/1979 | Davidson et al. | 343/702 |
| 4,509,056 | 4/1985 | Ploussios | 343/792 |
| 4,591,863 | 5/1986 | Patsiokas | 343/830 |
| 5,317,325 | 5/1994 | Bottomley | 343/702 |
| 5,440,317 | 8/1995 | Jalloul et al. | 343/702 |
| 5,585,807 | 12/1996 | Takei | 343/702 |
| 5,652,598 | 7/1997 | Campbell et al. | 343/792 |
| 5,668,559 | 9/1997 | Baro | 343/702 |

FOREIGN PATENT DOCUMENTS

| | | |
|---|---|---|
| 526121 | 11/1940 | United Kingdom . |
| 2 141 878 | 3/1985 | United Kingdom . |

*Primary Examiner*—Don Wong
*Assistant Examiner*—Tan Ho
*Attorney, Agent, or Firm*—Parkhurst & Wendel, L.L.P

[57] ABSTRACT

An antenna apparatus with a coaxial cable used as a radiation element includes an antenna element having a first electrical length and a feeding point at an end. The coaxial cable is a second electrical length and both the inner and an outer conductors are coupled to a radio wave circuit at corresponding ends. An opposite end of the inner conductor connects to the feeding point of the antenna element. The first and second electrical lengths are selected to have resonance between the antenna element and the coaxial cable so that a radio wave signal is transmitted from both the antenna element and the outer conductor of the coaxial cable. The electrical length may be one quarter wavelength and the coaxial cable can be made of elastic material. Resonance is provided by generating a standing wave along the antenna element and the coaxial outer conductor at one quarter wavelength the desired frequency. By using the outer conductor of the coaxial cable as a radiation element unbalanced current can be prevented from flowing into the radio wave circuit. The elasticity of the coaxial cable permits close proximity between the antenna element and the radio wave circuit, allowing for miniaturization of the apparatus.

6 Claims, 3 Drawing Sheets

ANTENNA APPARATUS WITH A COAXIAL CABLE USED AS A RADIATION ELEMENT

BACKGROUND OF THE INVENTION

1. Field of the Invention

This invention relates to an antenna apparatus.

2. Description of the Prior Art

A coaxial type vertical antenna so-called a sleeve antenna used for a radio wave apparatus as an antenna apparatus is known. FIG. 3 is a cross-sectional side view of a prior art sleeve antenna. An antenna apparatus comprises a coaxial cable, a balun 107, and an antenna element 101 which is provided by extending the inner conductor 102 of the coaxial cable. The inner conductor 102 and an outer conductor 103 of the coaxial cable are connected to a radio wave circuit 105 at connection points 104. The inner conductor 102 transmits an electric power from the radio wave circuit 105 to the antenna element 101. Around the outer conductor 103 of the coaxial cable, a coaxial sleeve electrically connected to the outer conductor 103 at a connecting point 106 is provided as a balun 107. The balun 107 forms another coaxial structure with the outer conductor 103 and removes an unbalanced current flowing through the outer conductor 103. Numeral 108 denotes a case of the radio wave apparatus.

An operation of the above-mentioned prior art antenna apparatus will be described.

A length of the antenna element 101 is a quarter of a wavelength used and acts as a monopole antenna. A length of the balun 107 is adjusted to a quarter of a wavelength to provide a tuned condition at the desired frequency. An impedance of the outer conductor 103 viewed from the connection point 106 becomes infinite at an opposite end from the connection point 106, that is, that point shows an open condition, so that if a voltage is applied to that point, no current flows through the outer conductor 103. As the result, this prevents an unbalanced current from flowing through an earth of the radio wave circuit from the antenna side and prevents a deterioration of a characteristic of the radio wave circuit 105.

SUMMARY OF THE INVENTION

The aim of the present invention is to provide an improved antenna apparatus.

According to the present invention, an antenna apparatus is provided, which comprises: an antenna element having a first electrical length and a feeding point at an end thereof; and a coaxial cable having an inner conductor and a coaxial outer conductor having a second electrical length, one end of the inner conductor being connected to the feeding point, another end of the inner conductor and a corresponding end of the coaxial outer conductor being to be coupled to a radio wave circuit, the first and second electrical lengths being determined to have a resonance to transmit a radio wave signal from the antenna element and the outer conductor on a transmission mode.

In the antenna apparatus, the first and second electrical lengths may be substantially a quarter of a wave length used.

In the antenna apparatus, the coaxial cable may be elastic.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Hereinbelow will be described an embodiment of this invention.

Figure 1:
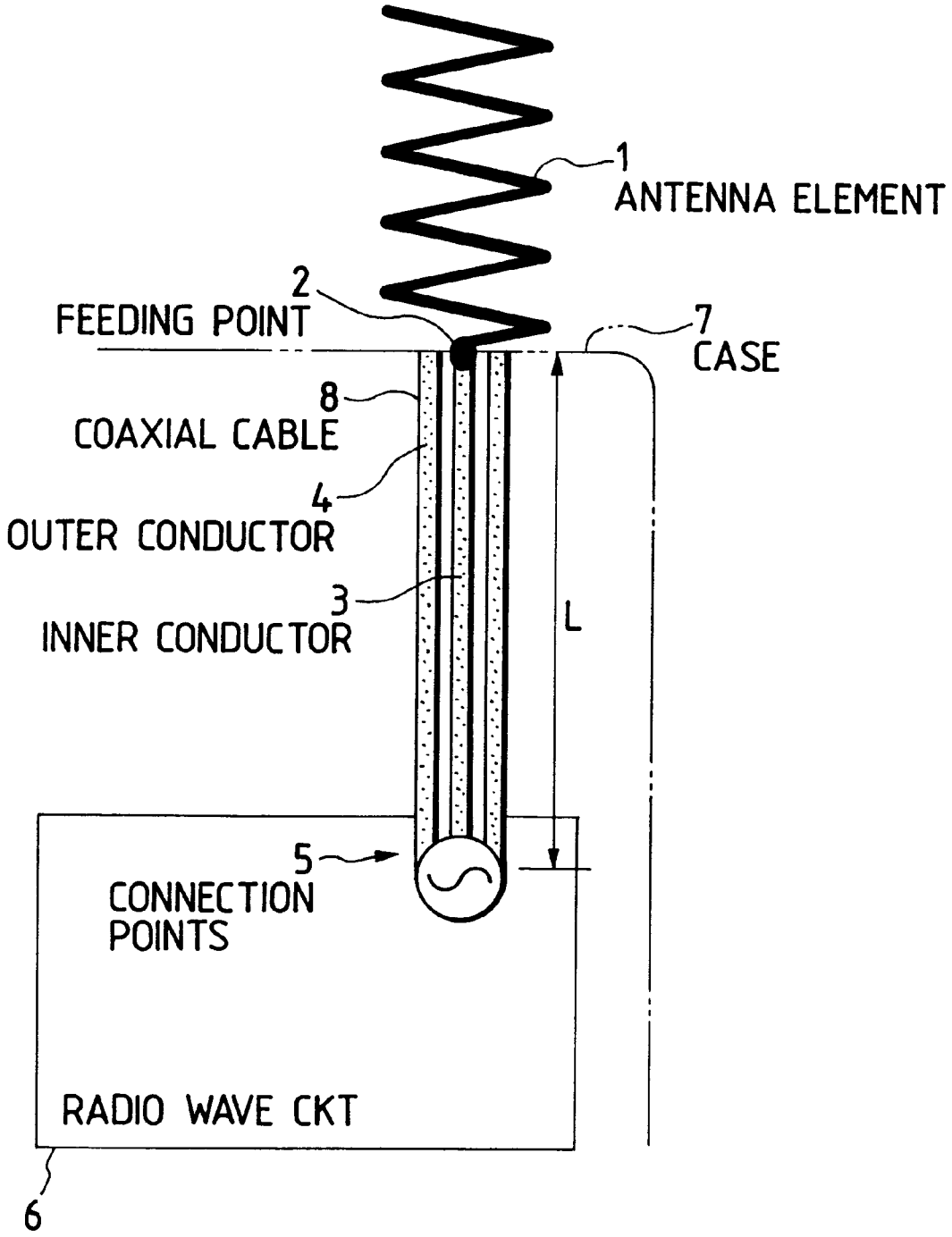
FIG. 1 is a cross-sectional side view of an antenna apparatus of an embodiment of the present invention.

FIG. 1 is a cross-sectional side view of an antenna apparatus of the embodiment of the present invention. In FIG. 1, numeral 1 denotes an antenna element having a helical form electrically connected to an inner conductor 3 of the coaxial cable 8 at a feeding point 2. An outer conductor 4 and is provided around the inner conductor 3 of the coaxial cable. That is, the inner conductor 3, the outer conductor 4, and an insulator between the inner conductor 3 and the outer conductor 4 form the coaxial cable 8. The inner conductor 3 and the outer conductor 4 are connected to a radio wave circuit 6 at the connection points 5 and transits an electric power from the radio wave circuit portion 6 to the feeding point 2. Numeral 7 denotes a case of the radio wave apparatus including this antenna apparatus and the radio wave circuit 6.

An operation of the antenna apparatus having the structure as mentioned above will be described.

Figure 2:
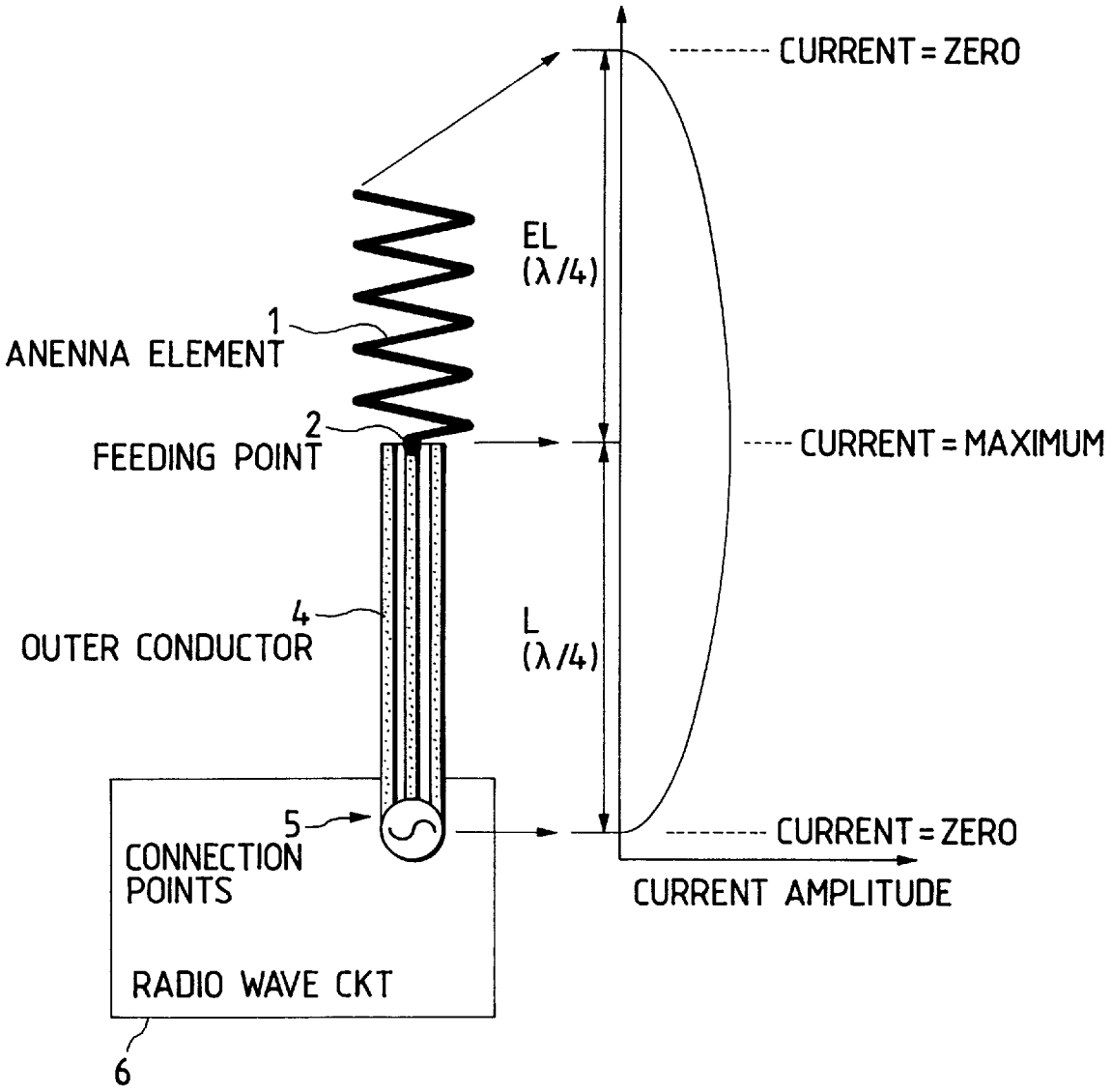
FIG. 2 is an illustration of this embodiment showing current amplitudes along the antenna element and the outer conductor of the antenna apparatus.
Figure 3:
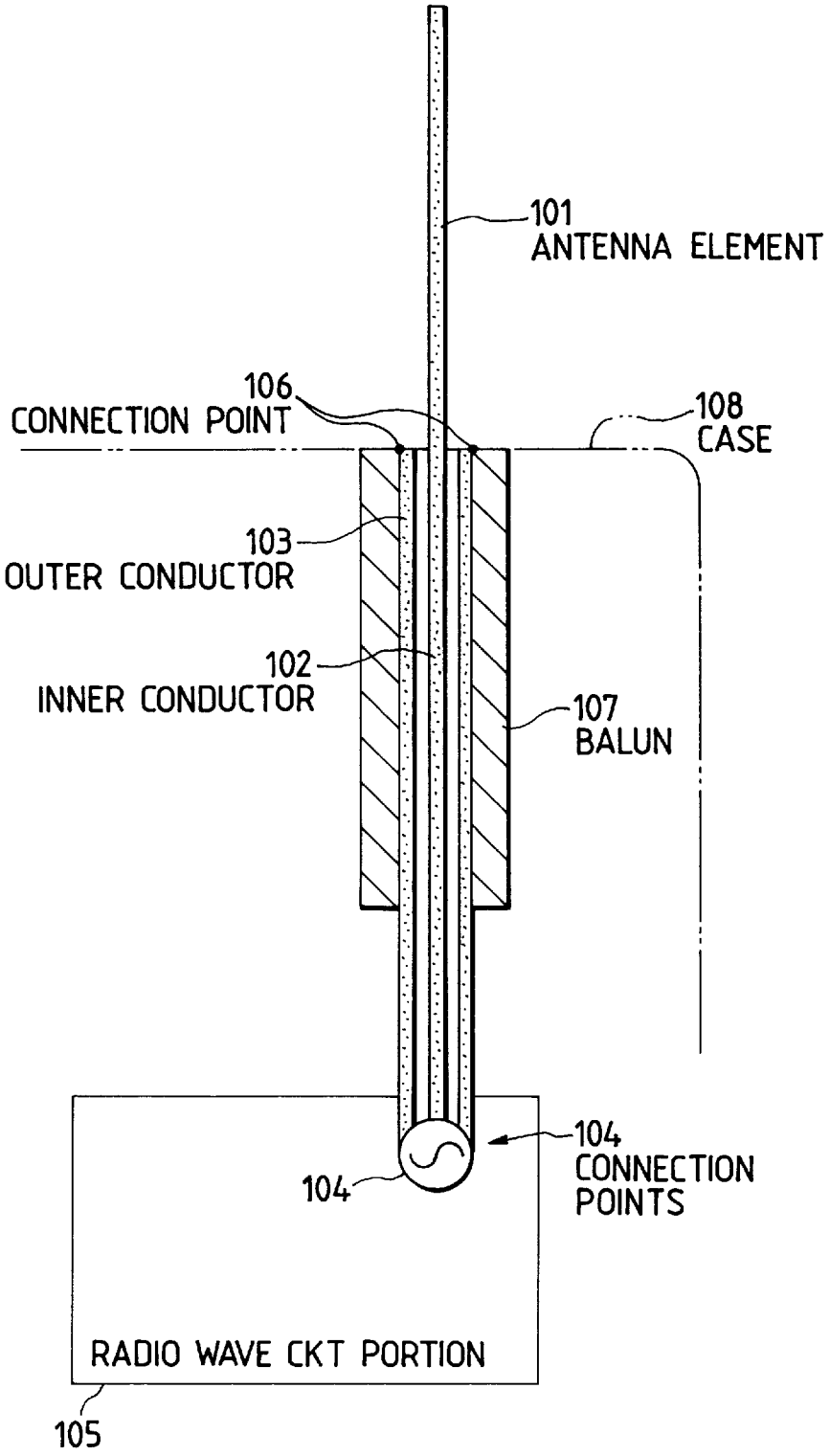
FIG. 3 PRIOR ART
FIG. 3 is a cross-sectional side view of a prior art sleeve antenna.

FIG. 2 is an illustration of this embodiment showing current amplitudes along the antenna element 1 and the outer conductor 4. The antenna element 1 has an electrical length EL of a quarter of a wavelength $\lambda$ of the desired frequency and energized by a current flowing thereinto through the feeding point 2. A current flowing through the outer conductor 4 is induced by the current flowing through the inner conductor 3 and is reflected at an end of the outer conductor 4 corresponding to the feeding point 2 and then, flows toward the connection point 5. Assuming that a length L of the coaxial cable 8 is a quarter of a wavelength of the desired frequency, since the current at the feeding point 2 is maximum, a current flowing through the outer conductor 4 of the coaxial cable 8 at the connecting point 5 is zero. Accordingly, a standing wave is generated along the antenna element 1 and the outer conductor 4 of the coaxial cable 8. That is, a current distribution is provided which shows a maximum current amplitude at the feeding point 2 and a minimum amplitude, that is, zero, at the connection point 5 on the opposite side from the tip portion of the antenna element 1, so that a resonance condition is provided. Thus, a dipole antenna is formed by the antenna element 1 and the outer conductor 4 of the coaxial cable, wherein the outer conductor 4 of the coaxial cable acts as an emission element. In this condition, the current in the outer conductor 4 of the coaxial cable 8 at the connecting point 5 is zero, so that the outer conductor 4 is electrically disconnected from the radio wave circuit 6. Accordingly, an unnecessary current flows into an earth of the radio wave circuit 6 from the antenna side. As the result, the earth of the radio wave circuit 6 does not act as an antenna, so that a characteristic of the radio wave circuit 6 is not disturbed.

As mentioned, because, according to the embodiment mentioned above, the resonance condition is provided by generating the standing wave along the antenna element 1 and the outer conductor 4 of the coaxial cable 8 by setting the length L of the coaxial cable to the quarter of the wavelength of the used frequency. The outer conductor 4 of the coaxial cable 8 can act as the emission element, so that an unbalanced current can be prevented from flowing into the radio wave circuit 6. Moreover, because the coaxial cable has an elasticity, the antenna element 1 and the radio wave circuit portion 6 are made close each other, so that the antenna apparatus can be miniaturized.

In the above-mentioned embodiment, the length L of the coaxial cable 8 is assumed as the quarter of the wave length. The length of the coaxial cable is affected by parts or the like arranged around the coaxial cable, so that the length may vary with the its circumference condition.

As mentioned the antenna apparatus of this embodiment comprises the antenna element 1 having the electrical length EL and the feeding point 2 at an end thereof; and the coaxial cable 8 having the inner conductor 3 and the coaxial outer conductor 4 respectively having an electrical length L, one end of the inner conductor 3 being connected to the feeding point 2, another end of the inner conductor 3 and a corresponding end of the coaxial outer conductor being to be coupled to the radio wave circuit 6 at the connection points 5, the electrical lengths EL and L being determined to have a resonance to transmit a radio wave signal from the antenna element 1 and the outer conductor 4 on a transmission mode.

The electrical lengths EL and L are substantially a quarter of a wave length used. Moreover, the coaxial cable 8 is elastic.

What is claimed is:

1. An antenna apparatus comprising:

an antenna element having a first electrical length and a feeding point at an end thereof; and a coaxial cable having an inner conductor and a coaxial outer conductor respectively having a second electrical length, one end of said inner conductor being directly connected to said feeding point, another end of said inner conductor and a corresponding end of said coaxial outer conductor being coupled to a radio wave circuit, said first and second electrical lengths being determined to have a resonance to transmit a radio wave signal from said antenna element and said outer conductor on a transmission mode wherein said first electrical length and said second electrical length are defined between a connection point to a radio wave circuit and said feeding point.

2. An antenna apparatus as claimed in claim 1, wherein said first and second electrical lengths are substantially a quarter of a wave length used.

3. An antenna apparatus as claimed in claim 1, wherein said coaxial cable is made from elastic material.

4. The antenna apparatus as claimed in claim 1, wherein said coaxial outer conductor acts as a radiation element.

5. The antenna apparatus as claimed in claim 1, wherein said antenna element and said coaxial outer conductor resonate.

6. The antenna apparatus as claimed in claim 1, wherein said antenna element and said coaxial outer conductor resonate to provide a dipole antenna structure.

* * * * *